United States Patent [19]

Elkins

[11] 3,992,727

[45] Nov. 23, 1976

[54] PORTABLE TOILET

[76] Inventor: Luther Elkins, 13031 Forest Drive, Bowie, Md. 20716

[22] Filed: Jan. 17, 1975

[21] Appl. No.: 541,987

Related U.S. Application Data

[63] Continuation of Ser. No. 388,903, Aug. 16, 1973, abandoned.

[52] U.S. Cl. ..... 4/10; 4/99; 4/115; 4/116; 280/47.31

[51] Int. Cl.[2] ..... E03D 7/00; E03D 13/00

[58] Field of Search ..... 4/1–8, 79, 4/109, 110, 114–117, 119, 120, 134, 167, 10, 89; D55/1 B; D23/48–50; 220/94 R; 280/47.31, 79.1

[56] References Cited

UNITED STATES PATENTS

| | | | |
|---|---|---|---|
| 445,513 | 1/1891 | Powell | 4/116 |
| 1,206,921 | 12/1916 | Scarborough | 4/109 |
| 1,638,040 | 8/1927 | Killen | 4/134 |
| 2,696,012 | 12/1954 | Hahn | 4/110 X |
| 3,066,311 | 12/1962 | Tharp | 4/119 X |
| 3,289,214 | 12/1966 | Corliss | 4/115 |
| 3,629,874 | 12/1971 | Beller | 4/115 X |
| D157,868 | 3/1950 | Horn | D23/48 |
| D193,420 | 8/1962 | Kulka | D23/48 |
| D203,740 | 2/1966 | Hilde, Jr. | D23/48 |

OTHER PUBLICATIONS

American Standard Catalogue, Mar. 1, 1965, Section 4, p. 6.

*Primary Examiner*—Harry N. Haroian
*Assistant Examiner*—Stuart S. Levy
*Attorney, Agent, or Firm*—Bacon & Thomas

[57] ABSTRACT

A portable urinal includes a base, a housing surrounding the base and a waste material receptacle in said housing. The housing is formed of a pair of molded one-piece portions, the forward of the two portions including a urine receiving basin which is connected to the receptacle. To facilitate movement of the urinal, a pair of wheels is provided on the base and handles are positioned on the housing. Also, a cable-like member is secured to the base and extends over the housing to provide means for picking up the unit by crane or the like. A trailer hitch is connected to at least one end of the base so that the urinal or a group of urinals may be towed. A degree of privacy is obtained by means of forwardly extending side members formed by the two one-piece housing portions. Finally a curtain may be provided around the front of the urinal, and chemicals can be pumped or poured into the receptacle.

15 Claims, 7 Drawing Figures

PORTABLE TOILET

This is a continuation of application Ser. No. 388,903 filed Aug. 16, 1973 now abandoned.

BACKGROUND OF THE INVENTION

1. Field of the Invention:

The invention relates to portable urinals, and particularly to portable urinals which are of a rugged construction and can be moved from place to place.

2. Prior Art

Portable toilets such as those illustrated in U.S. Pat. Nos. 445,513; 2,999,247 and 3,066,311 have been in use for many years. Also, small hand held urinals for invalid use and miniature ones for training children such as U.S. Pat. No. 2,769,982 are also well known.

It is often not necessary to have a complete portable toilet of type referred to above or of the single seat variety which are obviously large, bulky and expensive. At the same time, it is not feasible to use a small invalid-type urinal in an industrial environment.

Therefore, the instant invention meets current needs and overcomes the disadvantages of the prior art.

OBJECTS AND SUMMARY OF THE INVENTION

It is an object of the invention to provide a portable urinal which provides at least a limited amount of privacy, yet is not completely enclosed.

It is another object to provide a portable urinal which can be moved from site to site.

Another object is to provide a urinal which is completely selfcontained and is made of light-weight materials such as plastics, fiberglass, aluminum and light steel.

Another object is to provide a portable toilet wherein odors are reduced to a minimum.

Another object is to provide a portable urinal in areas which are unusually hard to service by providing means to hoist the unit with a crane to levels in buildings being constructed or down mineshafts and into tunnels.

It is another object to provide a portable urinal which can be moved from place to place by either towing or by rolling in a wheelbarrowtype fashion.

It is to be specifically recognized that while the term "urinal" is used throughout the specification, the same general structure can very easily apply to a toilet with a seat associated therewith.

A portable urinal includes a base, a housing surrounding the base and a waste material receptacle in said housing. The housing is formed of a pair of molded one-piece portions, the forward of the two portions including a urine receiving basin which is connected to the receptacle. To facilitate movement of the urinal, a pair of wheels is provided on the base and handles are positioned on the housing. Also, a cable-like member is secured to the base and extends over the housing to provide means for picking up the unit by crane or the like. A trailer hitch is connected to at least one end of the base so that the urinal or a group of urinals may be towed. A degree of privacy is obtained by means of forwardly extending side members formed by the two one-piece housing portions. Finally a curtain may be provided around the front of the urinal, and chemicals can be pumped or poured into the receptacle.

BRIEF DESCRIPTION OF THE DRAWINGS

The foregoing and other objects, features and advantages of the invention will become more apparent from the following detailed description and accompanying drawings wherein.

DETAILED DESCRIPTION OF THE INVENTION

Figure 1:
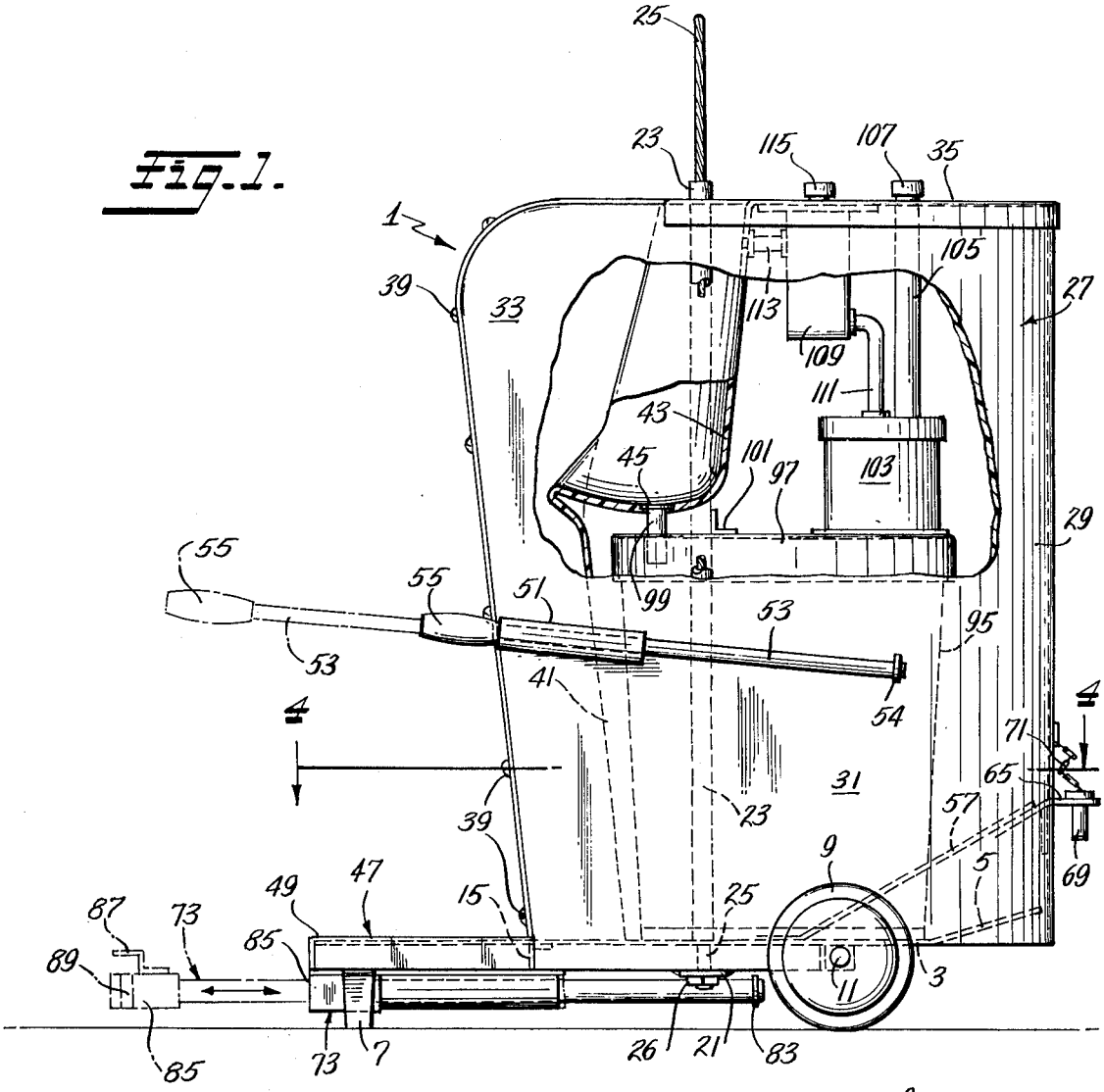
FIG. 1 is a side elevational view, partly in section of the portable urinal of the present invention.
Figure 2:
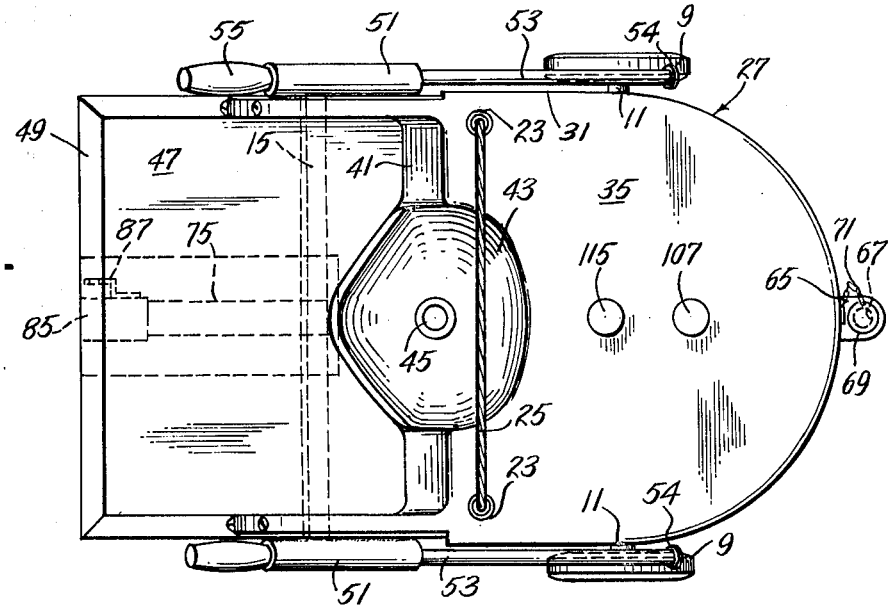
FIG. 2 is a plan view of the urinal of FIG. 1.
Figure 4:
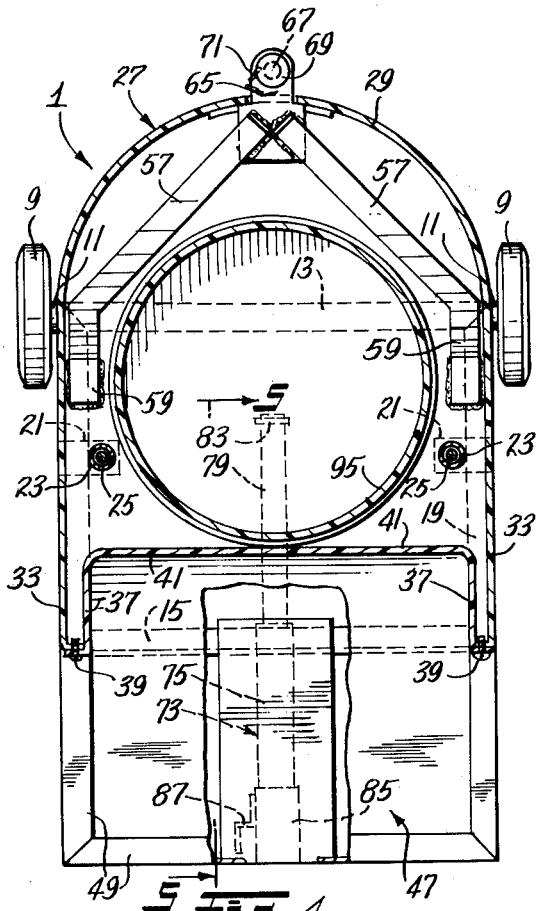
FIG. 4 is a longitudinal sectional view, taken along lines 4—4 of FIG. 1.
Figure 3:
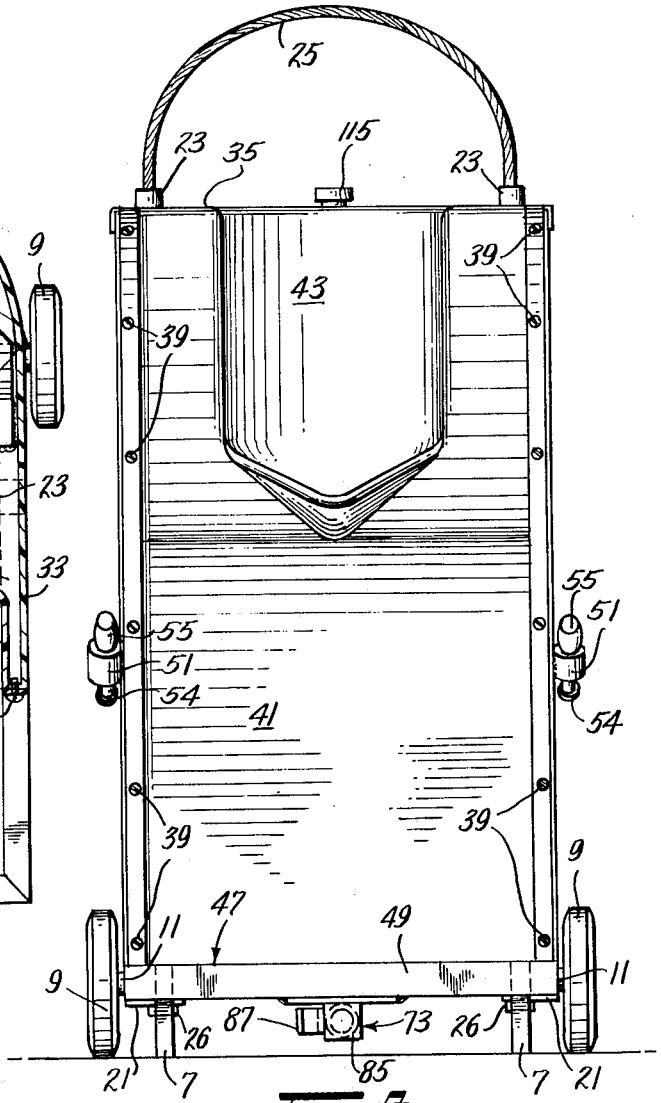
FIG. 3 is a front elevational view of the urinal of FIGS. 1 and 2.

Referring to the drawing a portable urinal 1 is seen having a base 3 with an upturned portion 5. The base 3 has a pair of legs 7 at one end and a pair of wheels 9 adjacent the other end. The wheels 9 are journaled on an axle 11 in a member 13 which is part of a frame having second and third parallel members 15 and 17. The entire frame which includes members 13, 15, 17 also includes a pair of longitudinal members 19 connecting the parallel members 13, 15 and 17. The frame in turn supports the base 3.

Positioned on the framing by means of a pair of brackets 21 are a pair of upstanding hollow rods 23. A U-shaped, flexible cable 25 is positioned in the rods 23 and bolted to the bottom at 26 in FIG. 1. The purpose of this cable as will be appreciated later is to facilitate moving the portable urinal by a crane to upper floors in a building being constructed, down a mineshaft or the like.

A semi-circular housing 27 of fiberglass or the like includes a rear cylindrical wall portion 29, a pair of side wall portions 31 and forwardly extending portions 33. Attached to the forwardly extending portions is another fiberglass member which includes a top 35, a pair of side portions 37 bolted or riveted at 39 to wall 33, a front portion 41 and a urine-receiving basin or dished area 43. The front wall portion 41 extends between the side walls 31, the front wall 41 having a first portion extending upwardly and a second portion extending generally upwardly and rearwardly toward the rear wall portion 29 with the basin 43 formed in and being a part thereof. An opening 45 is located in the bottom of the dished area 43. The top 35 includes openings to receive tubular members 23.

A standing platform area 47 is formed integrally with side elements 37 and front element 41. This standing area 47 is appropriately attached to the base by means such as metal stripping 49.

Secured to the side members 33 are a pair of tubular members 51 with a pair of shafts 53, each with a stop means 54 and a handle 55 secured thereto. The shafts 53 and handles 55 are slid in and out whereby they can be used to pivot the urinal on the wheels 9 for easy mobility. Obviously, small handle grips could be used instead of members 51–55.

Figure 5:
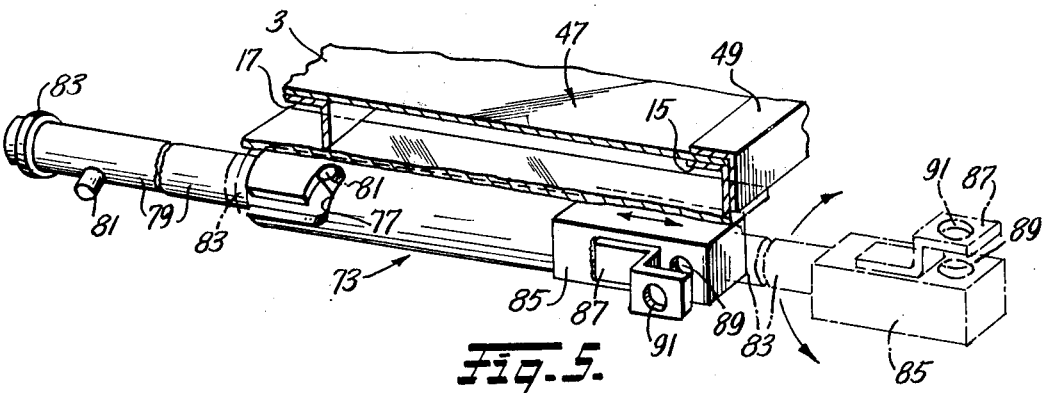
FIG. 5 is an enlarged fragmentary perspective view, partly in section, taken along lines 5—5 of FIG. 4.

Also attached to the base frame members 13 and 19 by welding or the like are a pair of angled members 57. These are secured to frame 13 and 19 by means of a pair of longitudinal portions 59. A conventional towing hitch means 65 including an opening 67 is attached to members 57. A pin 69 attached to the cylindrical portion 29 by a chain 71 is inserted to connect the urinal to a towbar 73 seen in detail in FIG. 5. The towbar includes a circular tubular members 75 on the frame having a bayonnet-type slot 77 therein. A shaft 79 with a pin 81 and an end stop 83 is slidably mounted in the tube 75. At the end of the shaft 79 remote from stop 83 is a block 85 having a Z-shaped member 87 mounted thereon. The block 85 and the Z-shaped member 87 have colinear holes 89 and 91 respectively to receive the pin 69. When the urinal is in use or in location the shaft and tow hitch is in the solid line position in FIG. 5. When it is desired to use the towbar, the shaft 79 is slid until pin 81 is in L-shaped bayonnet slot 77. When it reaches the end of slot 77, the shaft is rotated until it reaches the positions seen in FIG. 1 and in dotted lines in FIG. 5. The positioning of the pin 81 in slot 77 firmly locks the towbar from any longitudinal movement.

Inside the housing 27 is a tank 95 of suitable lightweight material such as plastic having a removable cover 97. An opening in the cover receives a drain pipe 99 firmly fitted in opening 45 of the dish portion 43. A ball check valve may be positioned in pipe 99 to prevent liquid from coming back into area 43 when the unit is tilted. A crossbar 101 is secured to the tubular members 23 to hold the waste material receptacle in the form of a tank 95 in position. A chemical supply tank 103 can be positioned on the cover 97 of the tank. A fill pipe 105 with an optional cap 107 extends through the top 35 of the outer housing. A chemical feed pump 109 having a tube 111 extending to the bottom of the supply tank 103 includes an outlet line 113 and a piston plunger handle 115 for pumping chemical from tank 103 down into the dished portion 43. This will permit the periodic insertion of chemicals into the tank 95 through pipe 99.

Figure 6:
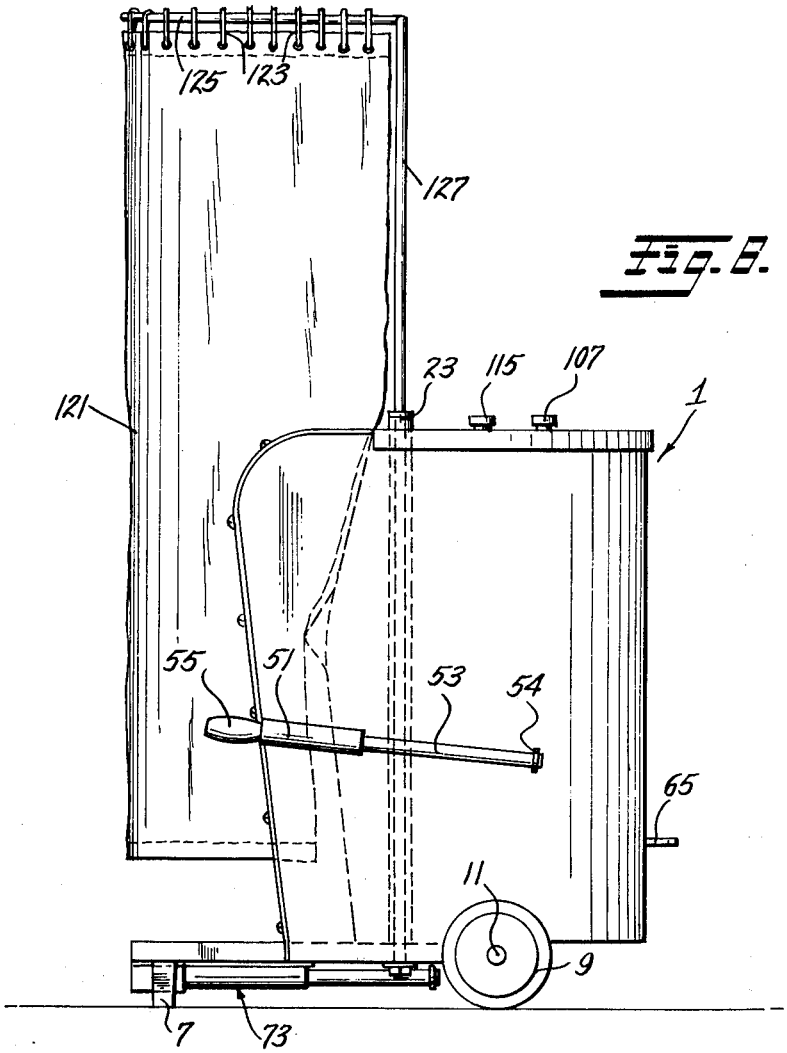
FIG. 6 is a side elevational view of a modification of the urinal having a curtain associated therewith for privacy.

The side portions 33, 37 provide for limited privacy. However, if additional privacy is desired, a curtain 121 as seen in FIG. 6 attached by means of conventional loops 123 to a U-shaped rod 125 can be secured to tubular members 127 which are slidably mounted in hollow rods 23.

Figure 7:
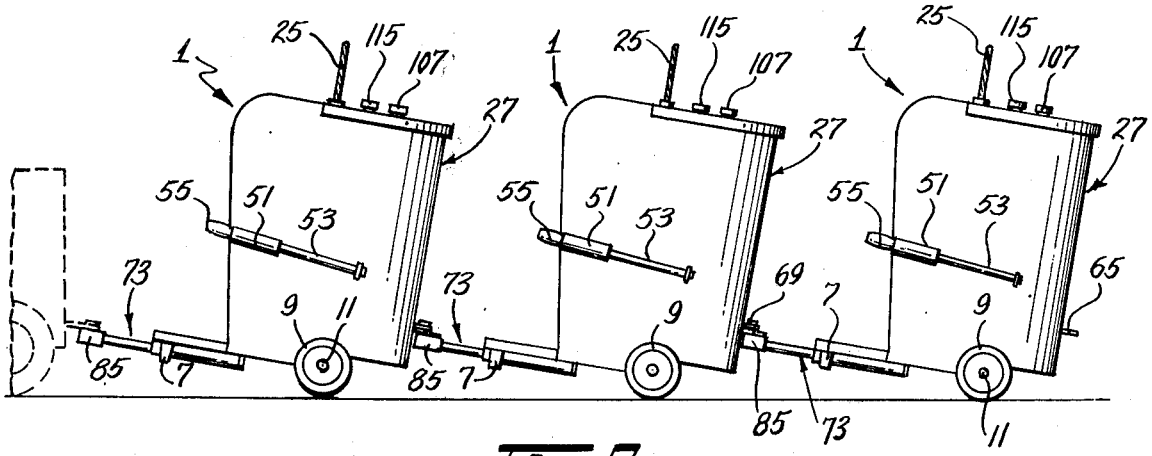
FIG. 7 is a side elevational view, on a smaller scale, of a multiplicity of portable urinals connected in tandem for removal to a service area.

The various units can be connected together by means of their towbar and hitch arrangements as seen in FIG. 7.

While one embodiment of the invention has been described, it will be understood that it is capable of many further modifications and this application is intended to cover any variations, uses, or adaptions of the invention following in general, the principles of the invention and including such departures from the present disclosure as come within knowledge or customary practice in the art to which the invention pertains, and as may be applied to the essential features hereinbefore set forth and fall within the scope of the invention or the limits of the appended claims.

I claim:

1. A wholly self-contained portable toilet comprising:

a. an enclosed housing having front, rear and side opposing walls, said front wall spanning the distance between said side opposing walls and having a first portion extending upwardly and a second portion extending generally upwardly and rearwardly from said first portion toward said rear wall;

b. a separate and distinct human waste receptacle within said housing;

c. a human waste basin formed in and being a part of said second portion and positioned above said receptacle;

d. said receptacle and said basin having openings therein, said basin opening being adjacent said receptacle opening whereby human waste passes from said basin into said receptacle and is wholly retained therein;

e. a pair of forwardly extending members, said forwardly extending members comprising a pair of substantially vertical side walls being positioned on said housing and extending outwardly and a substantial distance forwardly of said basin, whereby the user is provided with a degree of privacy, and f. means for facilitating movement of the toilet from place to place including wheel means for rolling the toilet.

2. A toilet as defined in claim 1 including handle means on said housing remote from said wheel means.

3. A toilet as defined in claim 1 including means extending above said housing having a cable secured to a base to permit picking the toilet up with a crane hook.

4. A toilet as defined in claim 1 including a trailer hitch means secured to at least one end of said base.

5. A toilet as defined in claim 1 including means for inserting chemicals into said receptacle, said chemicals inserting means including a reservoir above said receptacle, means for pumping chemicals from said reservoir into said basin.

6. A toilet as defined in claim 1 including a curtain-like means mounted on said housing and extending between said forwardly extending members to increase privacy.

7. A toilet as defined in claim 1 wherein said forwardly extending members extend at least substantially the height of said side walls and are formed integrally therewith, and a standing platform area extending between said forwardly extending members.

8. A toilet as defined in claim 7 wherein said standing platform area extends outwardly past the ends of said forwardly extending members.

9. A toilet as defined in claim 1 wherein said basin is a urinal and wherein said toilet includes a first one-piece portion forming said rear and two side walls of said housing, a second one-piece portion forming said front wall and having said urinal basin formed therein, and at least one of said portions having said forwardly extending members thereon.

10. A toilet as defined in claim 1 including means extending above said housing for connection to means for lifting the toilet.

11. A portable, wholly self-contained urinal comprising:

a. an enclosed housing having front rear and side opposing walls, said front wall spanning the distance between said side opposing walls and having a first portion extending upwardly and a second portion extending generally upwardly and rearwardly from said first portion toward said rear wall;

b. a urine receiving basin integrally formed in and being a part of said second portion and opening in an outwardly and a fowardly direction;

c. said basin having an opening in the bottom thereof;

d. a waste material receptacle within and surrounded by said housing, said receptacle having an opening therein;

e. said opening in said basin being positioned closely adjacent said receptacle opening whereby waste material from said basin passes into said receptacle and is wholly retained therein;

f. said housing having a pair of forwardly extending members thereon, said forwardly extending members comprising a pair of elongated, substantially vertical side wall means and extending outwardly and a substantial distance forwardly of said urine receiving basin for providing to the user a degree of privacy; and g. means for facilitating movement of the urinal from place to place including wheel means for rolling the toilet and means extending above said housing for connection to a means for lifting the toilet.

12. A urinal as defined in claim 11 wherein said housing comprises two molded pieces and said urine receiving basin is molded in one of said pieces.

13. A wholly self-contained portable toilet comprising:

a. molded enclosed housing having front, rear and side opposing walls, said front wall spanning the distance between said side opposing walls and having a first portion extending upwardly and a second portion extending generally upwardly and rearwardly from said first portion toward said rear wall;

b. a human waste basin molded integrally within said second portion;

c. a pair of molded forwardly extending members formed integrally with said housing and comprising substantially vertical side walls extending substantially the entire height of said housing and further extending outwardly and a substantial distance forwardly of said basin, whereby the user is provided with a degree of privacy;

d. a substantially horizontal standing platform area formed integrally with and extending between said side walls and connected by said integrally molded first portion with said basin;

14. A toilet as defined in claim 13 including means for facilitating movement of the toilet from place to place including wheel means for rolling the toilet and means extending above said housing for connection to a crane.

15. A portable toilet unit comprising:

a. a base frame, b. wheels on said base frame to permit moving the unit from place to place, c. a molded enclosed housing positioned on said base frame, said housing including:

1. a pair of side walls a front wall spanning the distance between said opposing side walls,
2. a rear wall connecting said side walls,
3. a toilet positioned in said housing between said side opposing walls and forward of said rear wall said toilet being connected to said front wall and opposing side walls,
4. said side walls extending forwardly of said toilet opening to provide a degree of privacy,
5. at least a portion of said side walls being unitary with and molded in the same piece of material as said toilet, d. a substantially horizontal standing platform area formed of the same piece of material integrally with and extending between said side walls and being integrally connected with said toilet, e. said toilet having an opening located about midway between said platform and the top of said housing, f. a pair of generally vertical, narrow upstanding members located generally centrally of the unit extending to near the top of said housing including means extending above said housing for connection to means for lifting the unit.

* * * * *